United States Patent [19]

Martin et al.

[11] 4,109,719

[45] Aug. 29, 1978

[54] METHOD FOR CREATING A PERMEABLE FRAGMENTED ZONE WITHIN A SUBTERRANEAN CARBONACEOUS DEPOSIT FOR IN SITU COAL GASIFICATION

[75] Inventors: William L. Martin; Harry A. Wahl, both of Ponca City, Okla.; Gary C. Young, Pinole, Calif.

[73] Assignee: Continental Oil Company, Ponca City, Okla.

[21] Appl. No.: 857,634

[22] Filed: Dec. 5, 1977

Related U.S. Application Data

[63] Continuation of Ser. No. 673,566, Apr. 5, 1976, abandoned, which is a continuation-in-part of Ser. No. 582,063, May 29, 1975, abandoned.

[51] Int. Cl.[2] ..... E21B 43/24; E21B 43/26

[52] U.S. Cl. ..... 166/259; 166/299; 299/2; 48/DIG. 6

[58] Field of Search ..... 166/247, 259, 299, 63, 166/260; 175/12; 299/2, 3, 13; 48/DIG. 6

[56] References Cited

U.S. PATENT DOCUMENTS

| | | | |
|---|---|---|---|
| 1,248,689 | 12/1917 | McAvoy | 166/299 |
| 2,630,307 | 3/1953 | Martin | 166/259 |
| 3,113,620 | 12/1963 | Hemminger | 166/257 |
| 3,233,668 | 2/1966 | Hamilton et al. | 166/259 |
| 3,465,818 | 9/1969 | Dixon | 166/247 |
| 3,470,953 | 10/1969 | Dunlap | 166/247 |
| 3,661,423 | 5/1972 | Garret | 299/2 |
| 3,674,089 | 7/1972 | Moore | 166/299 |
| 3,734,180 | 5/1973 | Rhoades | 166/259 |
| 3,775,073 | 11/1973 | Rhoades | 166/257 |
| 3,856,084 | 12/1974 | Parsons | 175/12 |

*Primary Examiner*—James A. Leppink
*Attorney, Agent, or Firm*—A. Joe Reinert

[57] ABSTRACT

A method for creating a zone of relatively high permeability within a subterranean carbonaceous deposit which includes gasifying a portion of the carbonaceous deposit to provide a cavity, placing at least one explosive device in the deposit in the vicinity of the cavity so that energy generated upon detonation of the explosive device extends into the cavity, and detonating the explosive device thereby causing a portion of the carbonaceous deposit to be fragmented and to collapse into the cavity.

7 Claims, 4 Drawing Figures

METHOD FOR CREATING A PERMEABLE FRAGMENTED ZONE WITHIN A SUBTERRANEAN CARBONACEOUS DEPOSIT FOR IN SITU COAL GASIFICATION

This is a continuation of application Ser. No. 673,566, filed Apr. 5, 76, now abandoned, which was a Continuation-in-part of our earlier filed application, U.S. Ser. No. 582,063 of the same title filed May 29, 1975 and now abandoned.

This invention relates to the gasification of subterranean carbonaceous deposits. In one aspect the invention relates to a method for creating a rubble zone in a subterranean carbonaceous deposit for in situ coal gasification. The invention further relates to a method for creating a rubble zone for in situ coal gasification by the use of conventional explosives.

In situ gasification of coal is an old concept and was first suggested by Mendeleeve in the year 1868. Since that time, numerous processes have been developed to implement the in situ gasification of coal concept, i.e., the Chamber Method, the Borehold-Producer Method, the Stream Method, and the Percolation Method.

U.S. Pat. No. 3,661,423 entitled "In Situ Process for Recovery of Carbonaceous Materials From Subterranean Deposits" teaches conditioning subterranean carbonaceous deposits, such as oil shale, for in situ recovery of carbonaceous values by limited undercutting (e.g., mining) of the deposit over a large area to leave an overlaying deposit supported by a multiplicity of pillars. The pillars can subsequently be removed by a variety of methods such as explosives and the like, thus causing the overlaying deposit to expand by collapsing, thereby filling the undercut area with particles of a uniform size, porosity, and permeability. Communication is then established with the upper layer of the expanded deposit, and a high temperature gaseous medium which will liquify or vaporize the carbonaceous values is introduced in a manner which causes the released values to flow downward for collection at the base of the expanded deposit. As is apparent, the method for creating the rubble pile leaves much to be desired because of the requirement that men go underground to mine portions of the carbonaceous deposit prior to using the explosives.

Other methods for producing rubble zones in a subterranean carbonaceous deposit proposed by the prior art involve the use of high energy devices, such as nuclear explosives. In many such processes, a plurality of nuclear explosives are placed within the deposit at predetermined distances so that upon a timed sequence detonation of the second explosion will cause a collapse of a portion of the deposit into a cavity formed by the first explosion. However, the use of nuclear explosives has been unsatisfactory from a safety standpoint, and stringent government regulations have been imposed on the use of such devices.

Thus the prior art methods for producing a permeable, fragmented zone within a subterranean carbonaceous deposit (e.g., a rubble pile) using explosives have been inadequate. Problems have been encountered in that when drilled holes are used for positioning conventional explosives the fractures produced upon detonation comprise a narrow fracture network. Vertical forward combustion in such a narrow fracture system often results in excessive resistance to gas flow. Such resistance is, in many instances, due to tar deposition in fractures, heat-induced swelling of the coal, and the like. In addition, the injected reactants often tend to channel through and predominately gasify coal in the immediate vicinity of the drill holes where a small-diameter, high-porosity rubble pile exists.

Therefore, a need has long been recognized for an improved method for remotely preparing a high-porosity, high-permeability "rubble pile" for coal gasification processes which does not require the use of mining or miners.

It has now been found that a high-porosity, high-permeability "rubble pile" is readily produced by employing a method for creating a zone of relatively high permeability within a subterranean carbonaceous deposit which includes gasifying a portion of the carbonaceous deposit to provide a cavity, placing at least one conventional explosive device in the deposit in the vicinity of the cavity so that energy generated upon detonation of the conventional explosive device extends into the cavity, and detonating the conventional explosive device thereby causing a portion of the carbonaceous deposit to be fragmented and to collapse into the cavity. The resulting rubble pile can then be gasified by partially combusting same at a fire front and recovering gasification products through a wellbore.

DESCRIPTION OF PREFERRED EMBODIMENTS

Figure 1:
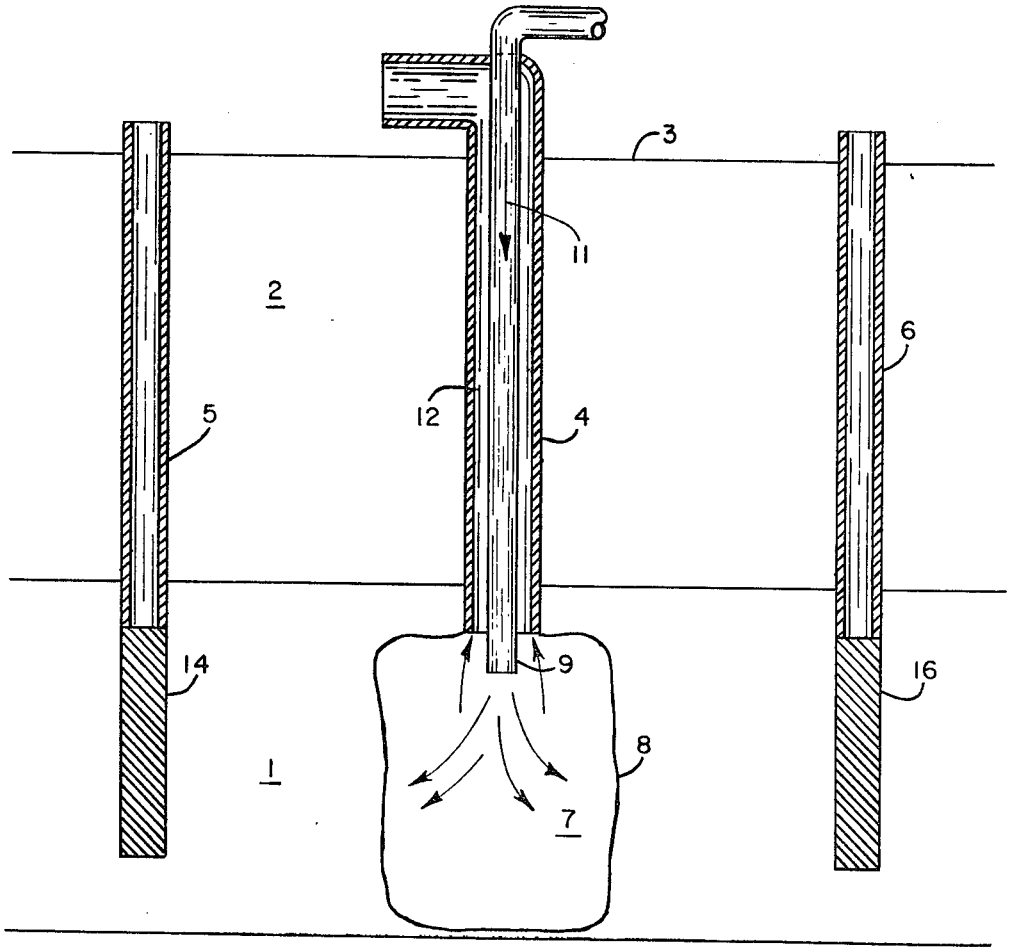
FIG. 1 is a schematic view of a coal-bearing formation taken in cross section and showing a cavity created by a blind borehole backreaming technique and the placement of conventional explosives with respect to the cavity.
Figure 2:
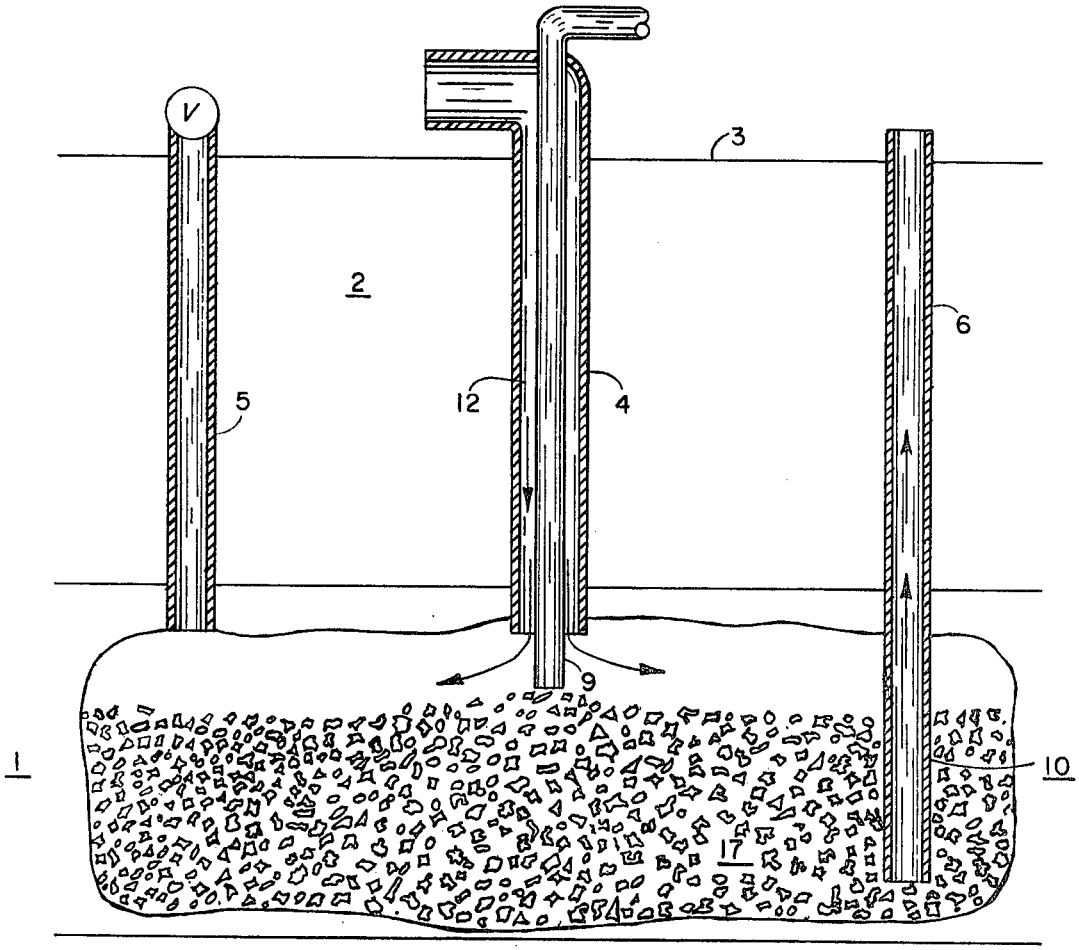
FIG. 2 is a schematic view of the formation of FIG. 1 showing rubble formed after detonation of the conventional explosives and the gasification of coal in the rubble.

Referring now to the drawings, and particularly to FIGS. 1 and 2, a coal deposit 1 is shown positioned beneath an overburden 2 and penetrated by a plurality of wellbores 4, 5, and 6 from the surface 3. Wellbore 4 penetrates coal deposit 1 and is used to form a combustion cavity 7. A free oxygen-containing gas, such as air, is introduced through an injection pipe 9, as shown by the arrows 11. As shown, the free oxygen-containing gas flows to the combustion surfaces, 8, where combustion occurs to produce combustion cavity 7. Ignition and combustion of the cavity surfaces are accomplished by means known to the art. One such method is shown in U.S. Pat. No. 3,856,084. An ignition device is shown in U.S. Pat. No. 3,379,256. The gasified products produced upon combustion are recovered through wellbore 4 and a product-gas recovery line 12. Once the desired cavity, i.e., combustion cavity 7 has been formed, conventional explosives 14 and 16, are positioned within coal deposit 1 through wellbores 5 and 6, respectively. The exact positioning of the conventional explosives within coal deposit 1 can vary widely provided, however, that explosives 14 and 16 are positioned within coal deposit 1 at an appropriate distance from cavity 7 to ensure that energy created by the detonation of explosives 14 and 16 can penetrate into combustion cavity 7. It is important that the energy generated by explosives 14 and 16 be sufficient to extend into cavity 7 if one is to obtain the desired rubble pile in coal deposit 1. The reason being that upon detonation of explosives 14 and 16, shock waves are emitted which travel toward cavity 7 and upon encountering the free interfaces 8, e.g., the side walls of cavity 7, the shock waves are reflected back towards their source as tensile waves which thus fracture and rubblize coal deposit 1, thus greatly enhancing the effect of the conventional explosive charge. The resulting rubblized zone 17, as shown in FIG. 2, is then penetrated by wellbore 6, which is redrilled into the rubble zone after detonation of explosives 14 and 16. As shown, production tubing 10 is positioned in wellbore 6 to extend to the lower portion of rubblized zone 17 so that gasification products created by partially combusting rubble pile 17 can be caused to flow downward through rubble pile 17 and be recovered. Wellbore 5 can optionally be completed similarly to wellbore 6, described above, or capped off by suitable means such as valves and the like to prevent the escape of gaseous products therethrough. Air is supplied to rubblized pile 17 through wellbore 4 or line 12 to insure that sufficient oxygen is present to maintain the desired combustion in carbonaceous rubble pile 17. Desirably, rubblized pile 17 is ignited at the top so that combustion proceeds downwardly and the gasification products are recovered through production tubing 10 from the lower portion of rubblized pile 17.

In order to obtain rubble pile 17 as shown in FIG. 2, it is desirable that combustion cavity 7 created by gasifying a portion of the subterranean carbonaceous deposit be equal to at least 10 volume percent of the carbonaceous deposit subsequently fragmented to form rubble pile 17. In order to obtain such, it is desirable that the distance between interfaces 8 of cavity 7 and explosive devices 14 and 16 be at least 5 feet. However, it is to be understood that by increasing the strength of explosive devices 14 and 16 and by increasing the size of cavity 7, one can extend the distance to from about 5 to 100 feet. Any suitable conventional explosive can be used. The term "conventional explosive" and "explosives" as used herein refers to non-nuclear explosives unless otherwise stated. Some examples of such explosives are ammonium nitrate/fuel oil systems and slurries, explosives such as aluminum/ammonium nitrate and TNT mixtures, and the like. Other such explosives known to the art can be employed, and it is to be understood that the process of the present invention is not limited to any particular type of explosive. The number of explosives and cavities deployed within the carbonaceous deposit can also vary widely. It is essential that at least one explosive device and one cavity be used. However, the number of such explosives and cavities employed will depend to a large extent on the size of the coal deposit, the size of the combustion cavity, and the strength of such explosives.

Figure 3:
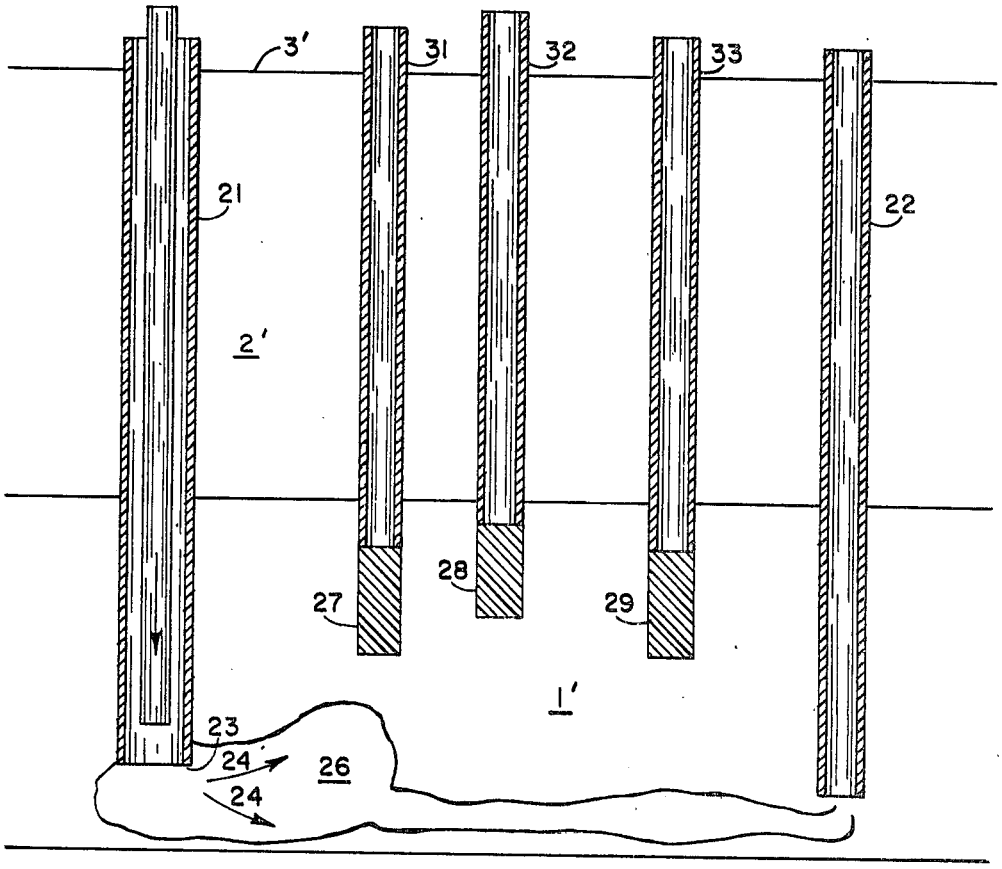
FIG. 3 is a schematic view of a coal-bearing formation taken in cross section and showing the creation of a cavity using a percolation-type gasification technique in a horizontally induced fracture and the placement of conventional explosives with respect to the resultant cavity.
Figure 4:
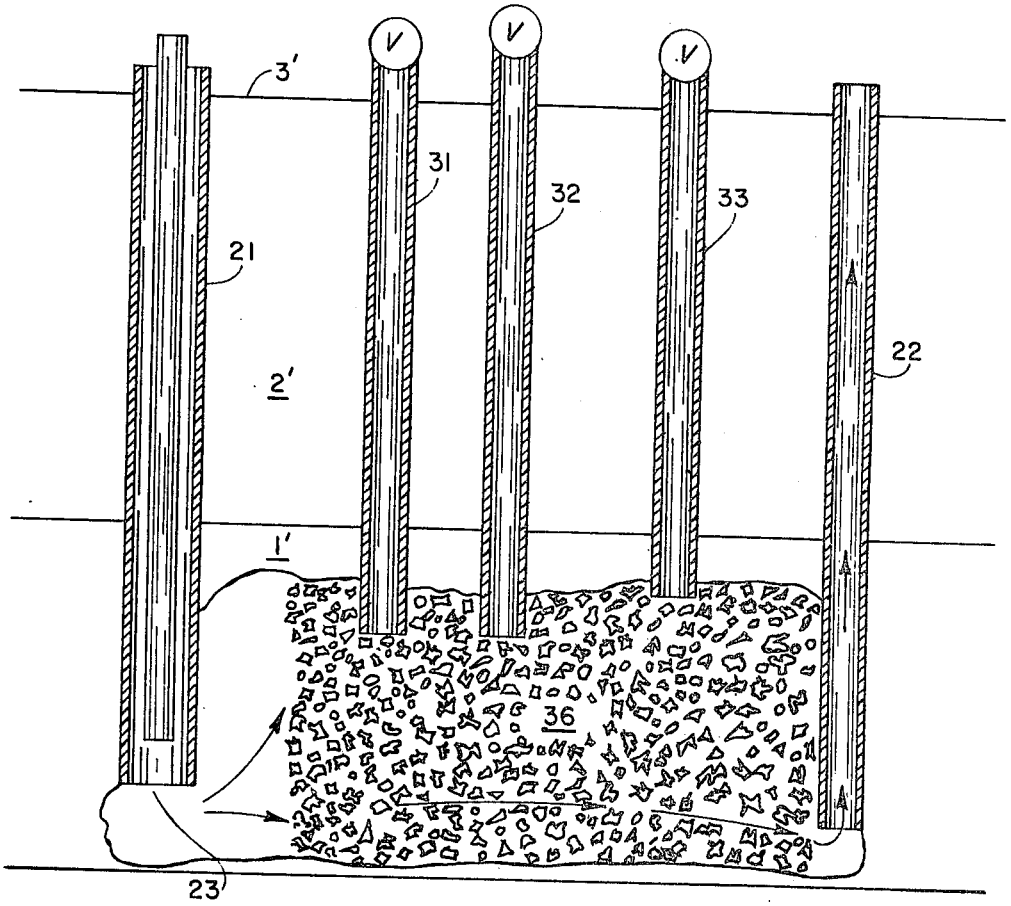
FIG. 4 is a schematic view of the formation of FIG. 3 showing rubble formed after detonation of the conventional explosives and the gasification of coal in the rubble by means of a horizontally moving reaction zone.

Referring now to FIGS. 3 and 4, a further embodiment of the method for creating a relatively high permeability zone within a subterranean carbonaceous deposit is depicted. A coal deposit 1' is shown positioned beneath an overburden 2' and penetrated by two wellbores 21 and 22 from the surface 3'. Carbonaceous deposit 1' between wellbores 21 and 22 is first horizontally fractured by any suitable means such as hydraulic pressure and/or air pressure. Such fracturing processes are generally known to the art as hydraulic fracturing or gas fracturing. Techniques such as formation notching and the like may be used in the coal bed to direct the direction of the fracture as desired. In a further variation of the present invention, vertical fractures may also be used, alone or in combination with horizontal fractures. Once deposit 1' has been fractured, a free oxgyen-containing gas is introduced through an injection pipe 23 positioned in wellbore 21, as shown by the arrows 24 and deposit 1' is ignited. The resulting gasification of deposit 1' results in the formation of an elongated substantially horizontal combustion cavity 26 by combustion of carbonaceous deposit 1'. This technique has been called "the percolation method" for coal gasification. Thereafter, a series of explosive devices 27, 28, and 29 are placed within carbonaceous deposit 1' at selected distances above cavity 26 so that upon detonation of such explosives, deposit 1' is caused to fracture, crumble, and collapse into cavity 26, thus creating the desired rubble pile 36. Wellbores 31, 32, and 33 employed to position explosives 27, 28, and 29 within carbonaceous deposit 1' above cavity 26 are then sealed off and capped by any suitable means such as valves. The detonation of explosives 27, 28, and 29 is timed so that the effects of the explosive charges are maximized. Obviously a plurality of such explosive charges can be positioned in each of wells 31, 32, and 33 for sequential detonation and the like, especially in thick deposits. Thereafter, ignition of rubble pile 36 is commenced by injecting free oxygen-containing gas through borehole 21. The gaseous products produced upon ignition by the partial burning and gasification of rubble pile 36 are recovered through wellbore 22. By employing this method, rubble pile 36 can be gasified to allow recovery of substantial quantities of relatively high BTU gaseous product.

As previously stated, the number of explosive devices employed, the number of cavities employed, and the distance of such devices from the cavity will vary depending upon the structural characteristics of the carbonaceous deposit, the size of the cavity, the explosive strength of the explosive, and the like.

As shown in U.S. Pat. No. 3,465,818; the use of nuclear explosives has been disclosed for the production of a "rubble pile" in subterranean carbonaceous formations and as shown in FIGS. 1 and 2 of U.S. Pat. No. 3,465,818 the use of such devices results in the production of a cavity upon detonation of the nuclear explosive. The formation then collapses into the cavity or is caused to collapse into the cavity by the use of additional nuclear devices. Attempts to achieve a similar result using conventional explosives have been less successful, at least partially as a result of the fact that conventional explosives are relatively low-energy devices by comparison to nuclear explosives and as a result do not result in the production of a cavity upon detonation. The formation is thus fragmented by narrow fractures which do not result in the formation of a "rubble pile" or the like since there is no space into which formation collapse can occur. It is also difficult to fracture the formation under such conditions. Such shortcomings are obviated by the present invention and similar results to those achieved using nuclear devices are accomplished without the use of nuclear devices. The hazards of radioactive gas excape and the like, as well as, the necessity for meeting stringent government regulations relating to the use of nuclear devices are avoided.

While the concept of the present invention has been depicted with reference to specific embodiments using various configurations of combustion cavities, it is to be understood that the exact configuration of the combustion cavity, the location of the explosive devices, and the particular coal gasification procedure employed will be dependent to a large extent on the size and characteristics of the carbonaceous deposit. It is to also be understood that upon completion of gasification of the first rubble pile, a cavity exists which can be used, in combination with additional explosive devices, to create an additional rubble pile. However, as previously stated, in order to allow formation of the rubble pile within the cavity, the positioning of the explosive devices must be such that upon their detonation, the shock wave tends to echo from a free surface or interface and the formation being fragmented is allowed to collapse and accumulate within the cavity or void.

Having thus described the invention, we claim:

1. A method for producing gasification products from a subterranean coal stratum comprising the sequential steps of:

a. vertically traversing the coal stratum with a first wellbore and a second wellbore;

b. hydraulically fracturing and propping the coal between the first wellbore and the second wellbore in the lower vertical portion of the coal stratum therebetween;

c. igniting the coal at a locus near the first wellbore and near the propped fracture in the presence of a free oxygen-containing gas;

d. introducing through the first wellbore a free oxygen-containing gas to the ignited locus of the coal to effect gasification of the coal and propagate a gasification zone through the coal along the fractured and propped zone between the first wellbore and the second wellbore to form a horizontally elongated combustion cavity between the first wellbore and the second wellbore with production of the gasified products of the combustion through the second wellbore;

e. positioning conventional explosives in the coal laterally adjacent to the horizontally elongated cavity and at least partially above the horizontal axis of the horizontally elongated cavity such that energy generated upon detonation of the explosives extends into the cavity;

f. detonating the explosives thereby causing the coal above and to the sides of the horizontally elongated cavity to be fragmented and to collapse into the cavity, thus creating a horizontally elongated rubblized zone of coal of relatively high permeability and porosity;

g. introducing a free oxygen-containing gas to the horizontally elongated rubblized zone by way of the first wellbore to combust the rubblized coal, with production of gasified production products through the second wellbore.

2. The method of claim 1 wherein the coal is lignite, sub-bituminous coal, or bituminous coal; wherein water is injected with the oxygen-containing gas; wherein the explosives of step (e) are positioned by means of wellbores penetrating to near the vicinity of the elongated cavity.

3. The method of claim 2 wherein steps (e), (f), and (g) are repeated in sequence.

4. A method for producing gasification products from a subterranean coal stratum comprising the sequential steps of:

h. vertically traversing the coal stratum with a wellbore;

i. igniting the coal at a locus near the wellbore in the presence of a free oxygen-containing gas;

j. introducing a free oxygen-containing gas to the ignited locus of the coal to effect gasification of the coal and to form a vertically elongated combustion cavity extending over the substantial vertical interval of the coal stratum near the locus of a wellbore with production of the gasified products of the combustion;

k. positioning conventional explosives in the coal near the cavity and in a horizontal orientation therefrom so that the energy generated upon detonation of the explosives extends into the substantially vertically elongated cavity;

l. detonating the explosives thereby causing the coal in horizontal proximity to the cavity along a vertical interval thereto to be fragmented into the cavity, thus creating a rubblized zone of coal of high permeability and porosity extending from the locus of the cavity to the locus of the explosives;

m. introducing a free oxygen-containing gas to the rubblized zone to combust the rubblized coal with production of gasified combustion products.

5. The method of claim 4 wherein the coal is lignite, sub-bituminous coal, or bituminous coal; wherein the oxygen-containing gas in step (j) is introduced through an injection pipe through the wellbore of step (h); the produced gas in step (j) is produced through the annulus between the injection pipe of the wellbore and the casing set in the wellbore; wherein the water is injected with the oxygen-containing gas; wherein the explosives of step (k) are positioned by means of wellbores penetrating to within the horizontal vicinity of the vertically elongated cavity; wherein the oxygen-containing gas introduced in step (m) is injected by way of the wellbore of step (h); and wherein the gasified combustion products produced in step (m) are produced by way of a wellbore employed to position the explosives.

6. The method of claim 5 wherein steps (k), (l), and (m) are repeated in sequence.

7. The method of claim 5 wherein volume of the cavity is at least 10 percent of the volume of the carbonaceous deposit rubblized in step (1).

* * * * *